United States Patent [19]

Jones et al.

[11] 4,164,268

[45] Aug. 14, 1979

[54] ADJUSTABLE PROTECTIVE ROLLERS FOR SUSPENDED SCAFFOLDING

[75] Inventors: Paul Jones; John H. Scheffer, both of Greensboro, N.C.

[73] Assignee: Clear Day, Inc., Greensboro, N.C.

[21] Appl. No.: 890,629

[22] Filed: Mar. 20, 1978

[51] Int. Cl.[2] ..... E04G 3/10

[52] U.S. Cl. ..... 182/150; 182/129; 182/222; 182/229

[58] Field of Search ..... 182/142, 143, 144, 150, 182/129, 222, 229

[56] References Cited

U.S. PATENT DOCUMENTS

| | | | |
|---|---|---|---|
| 788,171 | 4/1905 | Schwerin | 182/142 |
| 1,141,749 | 6/1915 | Alley | 182/113 |
| 1,919,016 | 7/1933 | Geer | 183/143 X |
| 2,541,556 | 2/1951 | Stinson | 182/144 |
| 3,158,223 | 11/1964 | Brown | 182/150 X |
| 3,347,339 | 10/1967 | Coole | 182/14 |
| 3,375,900 | 4/1968 | Conley et al. | 182/229 |
| 3,643,761 | 2/1972 | Melton | 182/19 |
| 3,681,565 | 8/1972 | Fisher | 182/142 X |
| 3,837,429 | 9/1974 | Harris | 182/142 X |

FOREIGN PATENT DOCUMENTS

| | | | |
|---|---|---|---|
| 1283852 | 2/1962 | France | 182/150 |
| 1387059 | 12/1964 | France | 182/150 |
| 93137 | 1/1969 | France | 182/142 |

*Primary Examiner*—C. J. Husar
*Assistant Examiner*—Conrad Berman

[57] ABSTRACT

One or more elongated roller assemblies may be selectively mounted at a variety of positions along the inner edge of a scaffold platform. The inner and outer edges of the platform each include a series of correspondingly spaced apertures therethrough which receive the support rods or shafts of the roller assemblies. When the roller assemblies are emplaced the rollers lie between the inner edge of the platform and the vertical wall of the building along which the scaffolding is moving, and the mounting or support rods extend entirely through the platform and act as reinforcement of the assembly.

2 Claims, 2 Drawing Figures

ADJUSTABLE PROTECTIVE ROLLERS FOR SUSPENDED SCAFFOLDING

BACKGROUND OF THE INVENTION

Suspended or pendant scaffolds of the type which are suspended by cables from the roof or cornices of buildings and move vertically along the walls thereof are frequently used by painting, cleaning, or window washing crews or for other activities where it is necessary to move personnel or equipment across the outer surface of a building or other structure. Very basically, the scaffolding rigs include a pair of side frames which are hung from the cables and include a stage or platform extending between the side frames on which is supported personnel or equipment. During the last few years, architects have often designed buildings that are primarily faced with glass or which have large expanses of windows within only narrow walls or mullions extending between them. When a suspended scaffolding rig is moving along the walls of such buildings there is considerable danger of the scaffold swinging into a window and breaking the window or otherwise damaging the face of the building.

Certain of the scaffolds known in the prior art include a roller or wheel adjacent the forward or building side of the platform or stage to act as a protective "bumper" between the rig and the building mullions or facing. Most of these rollers are permanently attached to the scaffold and cannot be laterally adjusted to align with the solid structural portions between glass panels of the building walls. Therefore the same scaffold is not easily adapted for use with a building having mullions or facings of varying dimensions. When a scaffold rig is to be used solely on a particular building the inability to laterally adjust the position of the rollers thereon presents no significant problem because the rollers will be initially attached to the scaffolding such that they coincide with the wall structure of the building. However, when a rig is to be operated by a contractor on several types of buildings or structures this can pose a significant problem.

To provide lateral adjustability some of the roller assemblies in the prior art are clamped onto the inner edge of the platform or are mounted on relatively short and, occasionally, not very strong shankpieces. Upon impact of the scaffold against a building, the aforementioned clamps may unlock or dislodge, or the shankpieces may snap in two and thereby render the bumper useless.

To the inventor's knowledge, there is no scaffold protective roller in the prior art which is successfully laterally adjustable along the forward or inner wall of the scaffold stage according to the wall structure of the building, in addition to being securely locked into position such that the roller assembly does not break or dislodge on impact.

SUMMARY OF THE PRESENT INVENTION

The present invention is directed to a protective roller assembly for suspended or pendant scaffolding rigs which is laterally adjustable to coincide with the mullions or solid portions of the vertical wall of a building or other structure, avoiding the windows therein. Each roller assembly includes a plurality of elongated, somewhat resilient rollers mounted in adjustable side-by-side relationship along the forward or inner wall of a scaffolding platform or stage. Each of these roller assemblies includes a pair of support rods extending through selected openings through the platform. In use, the individual groups of rollers are mounted along the forward wall of the platform such that they engage and move along the solid portions of the vertical wall of the building and provide clearance between the scaffold and the windows therebetween. The rollers extend outwardly a distance in front of the platform sufficient to provide a comfortable working space between personnel and the building wall and during normal usage the rollers move easily along the wall surface. If the platform is caused to swing for any reason, the resiliency of the rollers will help to avoid the shock and any ensuing damage to the building face.

At all times it is desired that the rollers move along the portions of the building wall between the windows. When a building is designed primarily of glass there are generally mullions, i.e., slender vertical and horizontal members which extend between the large expanses of glass; and when used on such buildings the scaffold bumpers according to the present invention may be laterally adjusted as to align with those vertical mullions.

The scaffold platform or stage according to the present invention includes a forward edge and a rear edge both of which include a vertical surface which extend downwardly from the primary load bearing surface of the stage. These vertically depending platform edges need only be deep enough to accommodate a series of laterally spaced apertures therethrough. These apertures are aligned in front and rear edges to receive the roller assembly support rods therethrough. When it is desired to mount the bumper on the scaffold rig, the mounting rods are inserted first through the forward edge aperture, then through the rear wall aperture, then locked therein by means of a cotter pin or other conventional locking method. When utilizing the scaffold on another job having a building of a different design, the mounting rods are withdrawn and moved laterally for insertion through the appropriate set of apertures.

In addition to providing a very secure mounting mechanism for the roller assembly, the mounting rods also act as a reinforcement means for the roller assemblies. On a conventional scaffold, the size of which is rapidly becoming standardized, there will generally be at least two and sometimes three such roller assemblies.

The objects of the present invention include: 1. The provision of a detachable, laterally adjustable bumper device for suspended scaffold rigs; 2. The provision of a detachable bumper device which is securely mounted on a suspended scaffold rig in such a manner that the bumper will absorb the shock of an impact against a structure wall without significant damage to either the wall or the bumper.

Other objects and advantages of the present invention will become apparent to those studying the detailed description of a preferred embodiment in conjunction with the accompanying drawings of which:

DETAILED DESCRIPTION OF A PREFERRED EMBODIMENT

Figure 1:
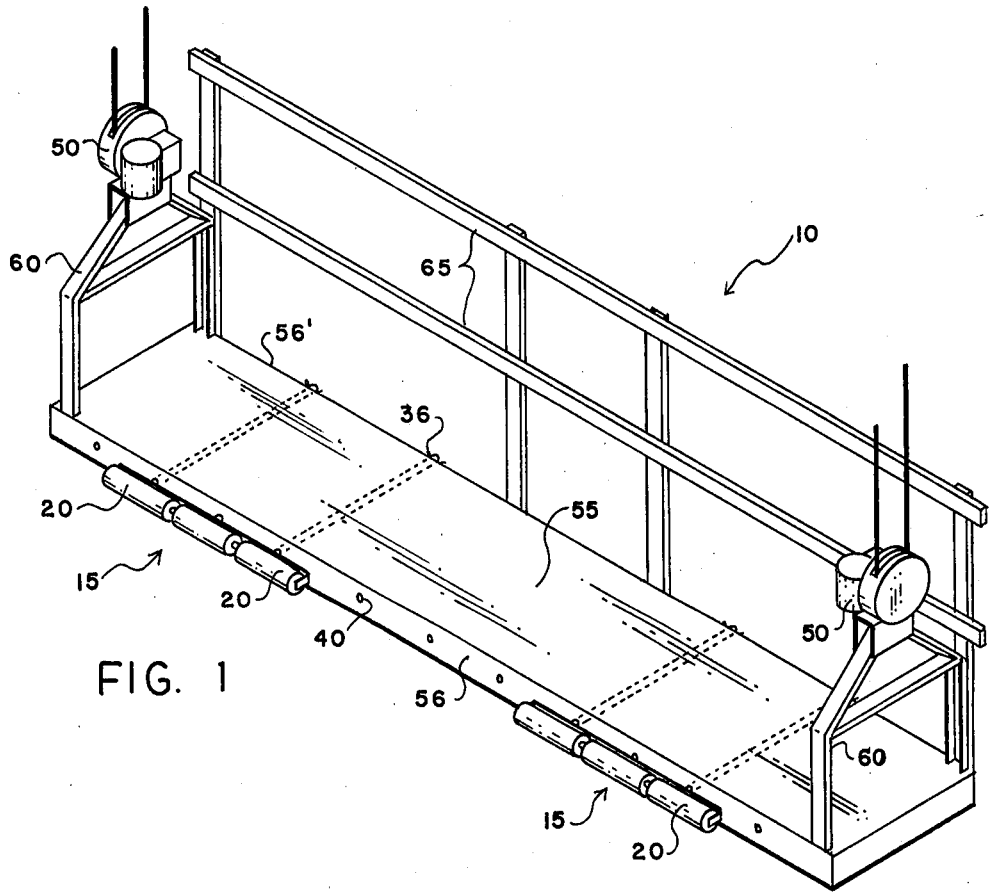
FIG. 1 is a perspective view of a scaffolding rig with the roller assembly of the present invention mounted thereon.
Figure 2:
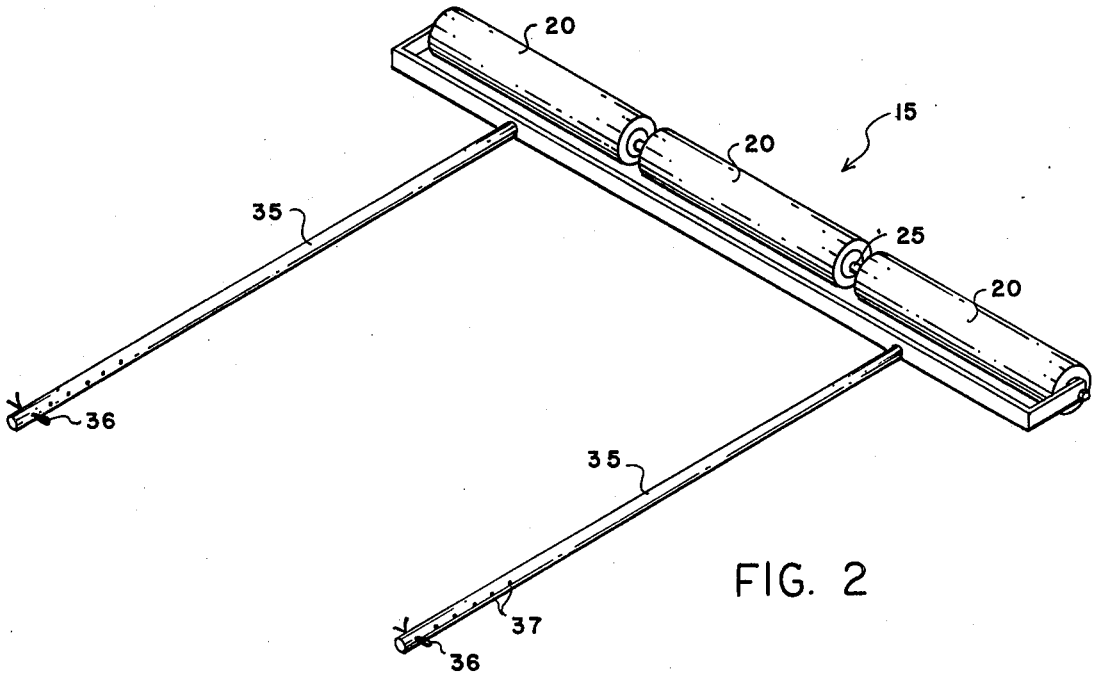
FIG. 2 is an enlarged perspective of the roller assembly according to a preferred embodiment of the present invention.

Turning now to a discussion of FIGS. 1 and 2, the suspended scaffolding rig 10 is shown with the roller assembly 15 securely emplaced thereon in readiness for moving equipment or personnel vertically along a building or structural wall. The scaffolding rig 10 includes a vertical suspension means 50 on opposite ends of a horizontal load platform 55. The suspension system 50 is generally conventional and will not be further described herein. As illustrated the rig 10 includes side frame structures 60 extending upwardly from opposite ends of platform 55 and a rear safety rail 65 extending horizontally between the side frames.

The load bearing platform 55 generally includes a forward edge 56 and a rear edge (not shown). It may be constructed of a solid sheet of metallic or wood material, or it may be fabricated by means of a series of elongated channel members which are mounted in side-by-side relationship to form a horizontally extending, flat, load bearing surface. Further details along this line will not be included herein because it is a matter of choice and construction of the platform and does not affect the present invention.

The roller assembly 15 in FIG. 2, a preferred embodiment, is illustrated as including a plurality of elongated rollers 20 formed of a resilient, shock absorbing material such as rubber. Rollers 20 are mounted in side-by-side relationship on an axially extending shaft 25, which in turn, is rotatably attached to a mounting bracket 30 having perpendicularly depending mounting rods 35. Construction materials for the mounting bracket 30 and rods 35 are not limited other than by the requirement that they be structurally strong enough to support the groups of rollers 20 thereon and also to absorb any blows or shock from the scaffold being swung or knocked against the building wall.

To mount the bumper device 15 on the scaffold rigging, the scaffold platform 55 includes a plurality of spaced horizontally extending passageways 40 therethrough commencing at front edge 56 and exiting through the rear edge. The mounting rods 35 are inserted through a selected pair of passageways 40, extending through the load bearing platform and through the corresponding pair of apertures in rear wall 56'. The perspective drawing illustrates two bumper attachments on the scaffolding rig 10 and generally speaking, because scaffolding rigs are rapidly becoming standardized in size, two attachments will be all that is necessary. However, it is obvious that more bumper attachments 15 may be utilized at times or occasionally it may be necessary to only use one. The bumpers 15 are placed on a scaffolding rig to align with the mullions or solid wall structure of a given building. When moving to a second building having a different wall structure, the cotter pins 36 are removed, the mounting rods 35 are withdrawn from the transverse passages 40 therein and moved to a second pair of passageways selected according to a desired new position. The rods 35 are then reinserted in to the second pair of passageways 40 through to the back wall where the cotter pins 36 are inserted in the appropriate aperture 37 to quickly and securely lock the roller assemblies into place.

The passageways 40 may be comprised of tubular members (not shown) which, by spanning the distance underneath the load bearing platform, thereby serve as reinforcement to the platform and also to the mounting rods 35.

As illustrated, it can be clearly understood that the mounting rods 35 extending entirely through the transverse dimension of the load bearing surface of the platform 55, and will thus act as reinforcement to the roller assemblies. The fact that the rods 35 extend through the platform 55 will aid in preventing the roller assembly from being snapped or broken off if struck against the building.

Other improvements and modifications may be made to the embodiment described without departing from the scope of the claims below.

What is claimed is:

1. A suspended scaffold for use in transporting equipment and/or personnel along the vertical wall of a building or structure, said suspended scaffold comprising:

(a) a load bearing platform including a forward edge, an opposite rear edge, and a plurality of passageways extending through said platform between said front and rear edges;

(b) suspension means operably connected to said platform for moving said platform along the vertical building wall while maintaining said platform horizontal with said front edge facing said building wall;

(c) a plurality of roller assemblies; each including:

(i) a mounting bracket carrying at least one force absorbing elongated roller formed of a resilient material;

(ii) at least two support rods secured to said mounting bracket and extending rearwardly therefrom, said support rods, when assembled, extending entirely through selected ones of said passageways from said front through said rear edge for detachably mounting said roller assembly at one of various selected points along said forward side of said platform;

(d) means for retaining said support rods in assembled relation through said platform; whereby said roller assemblies may be positioned on said platform at spaced points corresponding to the spaces between solid building portions extending between the windows thereof so that said rollers move along the building wall preventing damage thereto by said scaffold.

2. An improvement in suspended scaffolding rigs of the type having a horizontal platform with a front and rear edge and used in transporting equipment and personnel along the vertical wall of a building or other structure, said improvement including a detachable bumper attachment comprising:

(a) a plurality of elongated roller assemblies;

(b) each roller assembly comprising a roller support bracket with at least two elongated support rods extending rearwardly therefrom;

(c) a plurality of passageways extending horizontally through said platform from front to rear at spaced positions therein, the number of said passageways exceeding the number of support rods;

(d) means for releasably securing said support rods within said passageways with the rods extending entirely across the front to rear dimension of said platform;

(e) whereby said roller assemblies may be removed from a first set of passageways and inserted in another set of passageways to vary the spacing between said roller assemblies.

* * * * *